US008348776B2

(12) United States Patent
Crawford et al.

(10) Patent No.: US 8,348,776 B2
(45) Date of Patent: Jan. 8, 2013

(54) INTERSECTING PATH RIDE

(75) Inventors: David W. Crawford, Long Beach, CA (US); Edward A. Nemeth, Hermosa Beach, CA (US)

(73) Assignee: Disney Enterprises, Inc., Burbank, CA (US)

( * ) Notice: Subject to any disclaimer, the term of this patent is extended or adjusted under 35 U.S.C. 154(b) by 390 days.

(21) Appl. No.: 12/832,296

(22) Filed: Jul. 8, 2010

(65) Prior Publication Data

US 2012/0006221 A1 Jan. 12, 2012

(51) Int. Cl.
*A63G 1/24* (2006.01)
*A63G 1/00* (2006.01)

(52) U.S. Cl. ..... 472/43; 446/444; 104/77

(58) Field of Classification Search ..... 472/39, 472/40, 43, 59, 60; 446/444, 445, 446; 104/53, 104/60, 77, 78
See application file for complete search history.

(56) References Cited

U.S. PATENT DOCUMENTS 2,106,424 A * 1/1938 Einfalt ..... 246/117
2,259,691 A 10/1941 Harris
3,367,284 A * 2/1968 Lunzer ..... 104/60
5,791,254 A 8/1998 Mares et al.
6,062,942 A * 5/2000 Ogihara ..... 446/444
6,170,402 B1 1/2001 Rude et al.
2007/0089630 A1 4/2007 Gordon
2007/0089631 A1 4/2007 Gordon
2007/0089632 A1 4/2007 Gordon
2009/0272289 A1 11/2009 Baker et al.

OTHER PUBLICATIONS

McMullin, Lin, "The Scrambler or a Family of Vectors at the Amusement Park" Jan. 1999, vol. 92, Issue 1, p. 64.

* cited by examiner

*Primary Examiner* — Kien Nguyen
(74) *Attorney, Agent, or Firm* — Marsh Fischmann & Breyfogle LLP; Kent A. Lembke

(57) ABSTRACT

An intersecting path ride providing close vehicle interaction without risk of collision. The ride includes a track assembly defining first and second linear, open channels bisecting at a vehicle path intersection point. The ride includes first and second vehicle guides movable within the channels. The ride includes first and second vehicle subassemblies supported by the guides, and the vehicle subassemblies move or reciprocate with the guides along linear paths defined by the channels. The ride includes a vehicle positioning assembly that concurrently reciprocates the guides back and forth along the linear channels through the intersection point. The vehicle positioning assembly includes a connection link pivotally coupled to the guides, a drive motor with an output shaft, and a crank arm rigidly coupled to the output shaft at one end and pivotally coupled to the connection link at another end moving the midpoint of the link through a circular drive path.

19 Claims, 8 Drawing Sheets

INTERSECTING PATH RIDE

BACKGROUND

1. Field of the Description

The present description relates, in general, to amusement park rides and other entertainment rides such as spinning vehicle rides, and, more particularly, to amusement or theme park rides configured to provide passengers with close interaction and near misses with other passengers and vehicles in a non-intuitive but safe manner.

2. Relevant Background

Amusement and theme parks are popular worldwide with hundreds of millions of people visiting the parks each year. Park operators continuously seek new designs for rides that attract and continue to entertain guests. One well known ride design is a spinning vehicle or tea cup ride available at many theme parks. In this ride, small turntables (e.g., three turntables in some rides) are used to hold two to six or more vehicles. The riders or passengers enter the vehicles and, during the ride, are able to manually rotate their individual vehicle about a mounting location on the turntable independent of the other vehicles. Also, during the ride, each of the small turntables is rotated about its center axis while a larger turntable supporting the small turntable is also rotated in the same or an opposite direction.

To increase the thrill in such spinning vehicle and/or spinning turntable rides, ride designers often create near-miss or demolition derby interaction among the vehicles. The intent of these rides is to safely provide close interaction between passenger vehicles in a non-intuitive manner. For example, car-shaped vehicles may be provided in a near-miss theme park attraction. The vehicles may be located on one of four spinning plateaus or turntables. The vehicles change or move among the spinning plateaus during the ride while nearly missing other passing-by vehicles so that a passenger may not end the ride on the plateau that they began on in the attraction. Another close comparable for this type of ride are figure 8-type demolition rides that include spinning vehicles that are moved along a figure 8 track and have near-miss interactions at the crossing point of the track.

Existing spinning turntable, near-miss rides have been relatively popular over the years but present a number of problems for park operators. The existing rides are all based on a similar design that requires exact turntable synchronization. The rides may also use a relatively complex, high-wear handoff mechanism to move vehicles from one turntable to another, which increases maintenance and operating costs. The movements in the ride can also become predictable as the vehicles are constrained to a circular path of constant radius with no straight sections of track, with all vehicles following the same path throughout the ride in the same order.

Hence, there remains a need for an amusement park ride that provides a near-miss vehicle interaction between multiple vehicles. Preferably, such a ride would be less predictable or more non-intuitive than existing rides while providing a relatively low complexity design with acceptable maintenance requirements.

SUMMARY

The present description addresses the above problems by providing an amusement or theme park ride that includes one, two, or more vehicle positioning assemblies. Each vehicle positioning assembly makes use of a unique combination of a track assembly and two or more vehicle subassemblies to provide two, three, or more linear vehicle paths that each intersect at a central intersection point. The ride incorporates multiple intersecting linear paths (e.g., with use of open-channel track members/elements) to guide each vehicle subassembly in a manner that creates an illusion of near-miss collisions or vehicle/passenger interactions between the vehicle subassemblies (each which may include one, two, or more passenger vehicles).

The ride system includes multiple vehicle subassemblies that are constrained to individually dedicated track elements (i.e., only one subassembly per linear track element). However, the track elements bisect each other so as to define intersecting tracks or paths for each of the vehicle subassemblies. Vehicle subassemblies are connected together via a connection link (e.g., a rigid bar/arm or rigid frame) to define a vehicle positioning assembly, with each vehicle subassembly being pivotally coupled to the connection link. Further, the connection link includes a pivotally coupled intermediate attachment point such that the position of the connection link attachment point can move relative to the track elements. Typically, the vehicle positioning assembly includes a drive mechanism such as a motor for rotating a crank arm, which is rigidly attached at one end to the drive mechanism and pivotally coupled at the second or distal end to an intermediate mounting point on the connection link. The drive mechanism is operated to rotate the crank arm to rotate the distal end through a circular pattern/path (typically, at a constant velocity although that is not required) and cause the vehicle subassemblies to move along a path defined by an associated one of the track elements.

Vehicle subassembly motion is constrained to individual linear paths that intersect all other vehicle subassembly paths within a particular vehicle positioning assembly of the ride. In some embodiments, the paths are defined by an open, linear channel of a track element, and the channel intersects with other open, linear channels. Each vehicle subassembly may slidably or rollably engage a track channel via a sliding or rolling guide assembly that runs in the open channel (or otherwise mates with the track element) and ensures that the vehicle subassembly remains constrained within its dedicated linear path as well as to allow each subassembly to negotiate the intersection of the paths/track elements.

As will become clear from this description, the intersecting path ride provides several unique experiences depending, in part, upon the nature/design of the passenger vehicles provided within the vehicle subassemblies. For example, the vehicle subassembly may simply provide a passenger vehicle that is supported on a track guide assembly while in other cases the vehicle subassembly may provide a turntable that rotates upon the guide assembly (which is providing reciprocal linear motion) with one, two, or more passenger vehicles provided on the turntable (e.g., tea cup-type vehicles rotatable by the passengers, whip-type vehicles, and so on). In some embodiments, the vehicle subassemblies ride above tracks and the drive mechanism is positioned beneath the tracks, but, in some cases, it is useful to mount the tracks and drive mechanism above the vehicle subassemblies such that the passenger vehicles are suspended below the reciprocating rolling/sliding guide assemblies (e.g., the following description is not intended to be limited to either arrangement for supporting the passenger vehicles).

The experience achieved also depends upon where the passenger vehicles are mounted within a vehicle subassembly relative to the point at which the assembly is supported or mounted to the guide assembly (i.e., the point of the vehicle assembly that moves linearly along the track element). If the individual passenger vehicle is mounted within the vehicle subassembly at the "linear mounting point" (i.e., such that an axis extending through the guide assembly at the mounting point extends through the passenger vehicle), the passenger vehicle motion is generally along a line that intersects all other passenger vehicle paths. If the individual passenger vehicle is mounted beyond the "linear mounting point," the passenger vehicle motion is an ellipse that intersects all other vehicle paths and passes to either side of a central region, which is not traversed by any of the other passenger vehicles. If multiple passenger vehicles are provided in a vehicle subassembly (such as in a tea cup-type arrangement, a vehicle configuration similar to large circular vehicles with a perimeter array of seats as provided in the DISK'O™ rides manufactured by Zamperla Rides, or the like) and the platform/turntable or connection structure is mounted at the "linear mounting point," the passenger vehicles move in such a way that the group of passenger vehicles "orbit" around each other with individual passenger vehicles/compartments coming into alignment with, and pulling away from, individual passenger vehicles/compartments on other vehicle assemblies within each vehicle positioning assembly.

More particularly, an intersecting path ride is provided that includes a track assembly. The track assembly is configured, such as with elongated tracks, to define a first linear channel and a second linear channel. Typically, the channels are open on one side (e.g., a groove faces upward when vehicles are supported from below or downward when vehicles are supported from above), and, significantly, the channels intersect at an intersection point, such as where the two linear paths provided by the channels bisect each other. In this way, close interaction and even "near misses" can be provided near this interaction point.

The ride also includes first and second guides (or rolling/sliding guide assemblies) that are adapted for moving (or selective positioning) within (i.e., at least partially within or relative to) the first and second channels, respectively. The ride includes first and second vehicle subassemblies supported by the first and second guides, respectively, and the vehicle subassemblies move with the guides relative to the track assembly (e.g., in a reciprocating manner along the linear path defined by the channel dedicated to a particular vehicle subassembly). Typically, the vehicle subassemblies each include at least one passenger vehicle. To move the vehicle subassemblies along their dedicated linear paths, the ride includes a vehicle positioning assembly that concurrently reciprocates the first and second guides back and forth along the first and second linear channels, respectively, such that the first and second vehicle subassemblies separately pass the intersection point.

The vehicle positioning assembly includes a rigid connection link that is pivotally coupled (e.g., at its ends or at ends of supports/arms) to the first and second guides. During operation of the ride, the vehicle positioning assembly reciprocates the first and second guides with selective movement of the connection link. To this end, the vehicle positioning assembly may include a drive mechanism operating to selectively rotate a crank arm, and the crank arm typically would be rigidly attached at a first end to the drive mechanism but pivotally mounted at a second end to the connection link. In some embodiments, the drive mechanism includes a rotating output shaft rigidly coupled to the first end of the crank arm, with a longitudinal axis extending through the intersection point of the channels (e.g., a rotation axis for the ride). The first and second channels (or the paths they define) bisect each other at this intersection point.

To achieve desired movement with rotation of the end of the crank arm through a circular drive path, the connection link may be configured such that connection points between the connection link and the first and second guides are equidistant from the second end of the crank arm. Further, a length of the crank arm is about a distance between one of the connection points and second end of the crank arm (e.g., the crank arm may have a length "L" while the connection link may have a length of "2L" with the pivotal connection between the connection link and the second/distal end of the crank arm being at the midpoint of the length of the connection link).

In some embodiments, the first and second vehicle subassemblies each further include a turntable supporting the at least one passenger vehicle or are pivotally connected to the guide assembly. During operation of the ride, the turntable rotates about an axis extending through a corresponding one of the guides, and wherein the at least one passenger vehicle is pivotally coupled with the turntable for movement independent of movement of the turntable. In whip ride settings, each of the passenger vehicles may be pivotally coupled to a corresponding one of the guides proximate to one end of a body. Then, an opposite end of the body is rotatable away (back end whipping back and forth) from the channel during linear movement of the at least one passenger vehicle relative to the channel.

DETAILED DESCRIPTION OF THE PREFERRED EMBODIMENTS

Embodiments described herein are directed to an intersecting path ride for use in amusement and theme parks and other settings. The ride is unique in that it provides two, three, or more fixed paths, and, upon each of these paths (defined typically by linear track members with open channels), a vehicle subassembly is moved back and forth in a reciprocating manner. During this travel, the vehicle subassemblies seem to nearly collide or come into near miss interactions as the subassembly travels through an intersection point between the paths (or defining track members). Each vehicle subassembly may include a single passenger vehicle or two, three, or more passenger vehicles that are arranged for separate or synchronized movements (e.g., as tea cup-type vehicles on a rotating plateau or turntable, whip-type vehicles on a fixed or rotatable frame traveling along the linear path, or the like). To control or choreograph movement of the vehicle subassemblies, one or more vehicle positioning assemblies are provided in the intersecting path ride, and these positioning assemblies provide a connecting link between the vehicle subassemblies. A drive mechanism (e.g., a motor with a rotating shaft coinciding with the intersection point of positioning assembly) is used to rotate a crank arm attached to the connecting link (or linkage/frame) which maintains a fixed and safe spacing between vehicle subassemblies and moves all the vehicle subassemblies along their travel paths while providing safe but near-miss interaction.

The intersecting path rides described herein provide a number advantages and differences relative to prior close-interaction rides. The intersecting path rides allow passengers to follow a variety of paths ranging from a linear path to a spirograph-type path, depending on how their vehicle is positioned/mounted relative to a linear mounting location (e.g., over the linear path and a track guide assembly or offset from the vehicle subassembly's linear travel path). The intersecting path rides have the potential to eliminate lateral accelerations, which may be desirable in some ride applications. The rides may include rigidly linked vehicle subassemblies to ensure/guarantee safe separation distances are maintained. Motion in the ride can be achieved with a single drive motor for an entire ride or at least each ride subsystem (e.g., each grouping of a track assembly, vehicle subassemblies, and vehicle positioning assembly provided in a ride ranging from one to 4 or more) with a constant rotation rate for the motor or variable speed options provided in some cases. No vehicle handoff mechanisms are required such as between vehicle plateaus or turntables. The rides may utilize many different passenger vehicle shapes, sizes, and movements (whip, rotation about a central axis, manual and/or controlled by off-board control systems, and so on).

Figure 1:
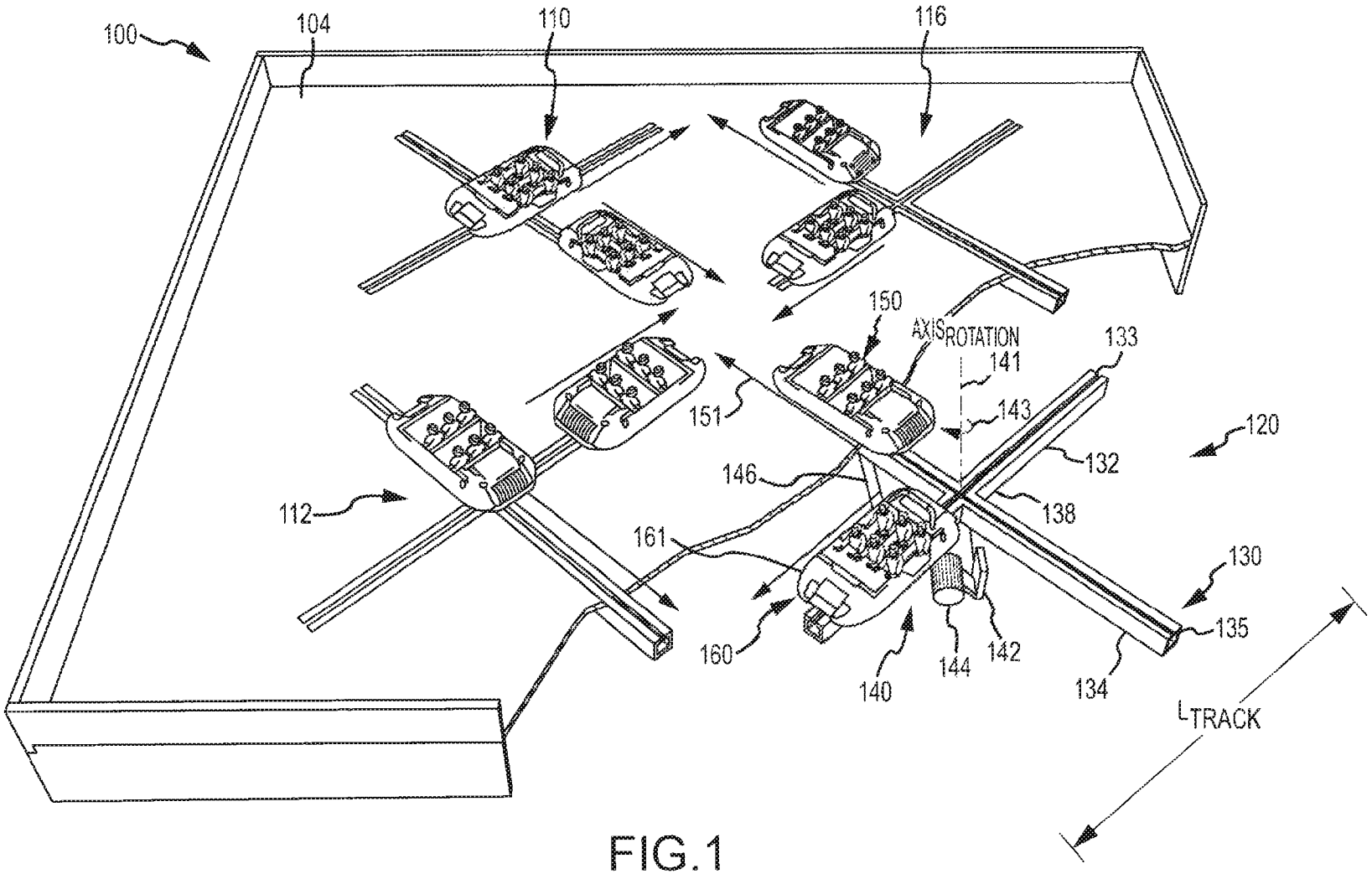
FIG. 1 is a perspective view of an amusement park ride with intersecting vehicle paths with a cutaway of a ride platform/floor showing more details of track assembly with intersecting, open-channel track members and also showing normally hidden portions of a vehicle positioning assembly (e.g., a drive motor and a connection link (or connecting link member/element))

FIG. 1 illustrates an intersecting path ride 100 according to one embodiment for providing passenger/riders of vehicles with close interaction and even near-misses in a safe and controlled manner. The ride 100 includes a based or platform 104 (such as for passenger/guests to enter and exit vehicles) upon which is provided a number of ride subsystems 110, 112, 116, and 120, which are each designed according to aspects of the invention to provide the intersecting path ride experience. In the following paragraphs, ride subsystem 120 is explained in detail, with it being understood that subsystems 110, 112, 116 would have similar configurations.

As shown in FIG. 1, ride subsystem 120 includes a track assembly 130 and a ride positioning assembly 140. The track assembly 130 includes a first track member/element 132 and a second track member/element 134. The track members 132, 134 are elongated structural components that each include or define a linear channel 133, 135 with an opening for allowing a coupling/mounting component to extend up (or down) to vehicle subassemblies 150, 160. In other words, the open channels 133, 135 define linear travel paths with particular lengths (e.g., $L_{Track}$) upon which the vehicle subassemblies 150, 160 may travel in the form of a grooved track. The track members 132, 134 bisect each other at an intersection point 138 such that the channels 133, 135 also intersect such that each of the vehicle subassemblies 150, 160 travels through the intersection point 138 during the ride. Due to the use of a connecting link 146, the vehicle subassemblies 150, 160 do not travel through the intersecting point 138 at the same time (and, further, adequate spacing is maintained by link 146 such that no contact is made between subassemblies 150, 160).

In addition to track assembly 130, the ride subsystem 120 includes the vehicle positioning assembly 140 to move passenger vehicles on the track assembly 130. The positioning assembly 140 includes a drive mechanism 144 (e.g., a drive motor rotating an output shaft) attached to or supported on base/platform 142. The drive mechanism 144 rotates a shaft (not shown in FIG. 1) with an axis of rotation 141 that rotates 143 to cause movement of a connecting link 146. Significantly, the rotation axis 141 of the drive mechanism 144 extends through the intersection point 138 of the track channels 133, 135 (or linear travel paths of vehicle subassemblies 150, 160), as will become clearer from discussion of FIGS. 3-5. The connecting link 146 may be considered a rigid connection between the vehicle subassemblies 150, 160 (with pivotal linkage at each end to a guide assembly traveling in channel 133, 135) that causes the vehicle subassemblies to move 151, 161 within the channels 133, 135 but to maintain a fixed distance between the assemblies 150, 160 (e.g., a separation distance defined by the length of the link 146 as well as the arrangement of tracks 132, 134).

The ride subsystem 120 includes a vehicle subassembly 150, 160 associated with each track member 134, 132, respectively. The vehicle subassemblies 150, 160 in this embodiment are single vehicles holding multiple passengers that each may be rigidly or otherwise mounted (such as for rotation by passengers or by a control system) to a guide assembly (not shown in FIG. 1), but other embodiments may include vehicle subassemblies that themselves include two, three, or more passenger vehicles on a vehicle turntable or other rigid or rotating support frame/platform. The vehicle subassemblies 150, 160 have a linear mounting or coupling location (such as with a guide assembly) and travel in a linear and reciprocal manner as shown with arrows 151, 161 along the linear travel path defined by open channels 133, 135 in track members 132, 134. Again, this travel 151, 161 occurs concurrently for the vehicle subassemblies 150, 160 due to operation of drive mechanism 144 to rotate 143 a crank arm (not shown) about central rotation axis 141 that passes through the intersection point 138 for the channels 133, 135, which causes movement of the connecting link 146.

Figure 2:
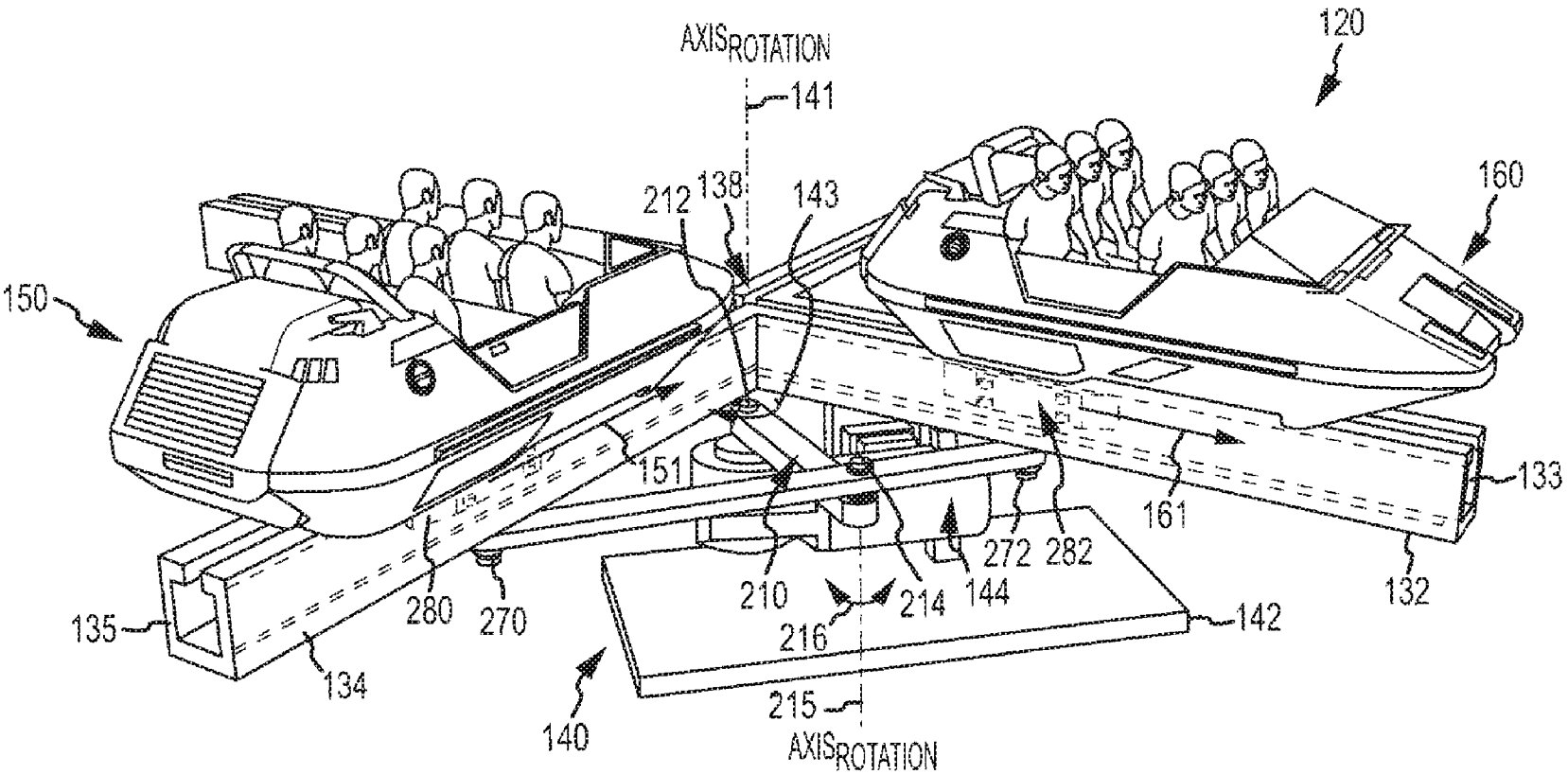
FIG. 2 illustrates a perspective view of one of the track assemblies and the vehicle positioning assemblies used to reciprocate a pair of vehicle subassemblies along paths defined by open-channel track members by rotation of a crank arm.

FIG. 2 illustrates the ride subassembly 120 in further detail. As shown, each vehicle subassembly 150, 160 slides, rolls, or moves 151, 161 back and forth in channel 135, 133 of track members 134, 132 and through the path intersection point 138. The intersection point 138 coincides with both the bisection of the channels 133, 135 and also with the axis of rotation 141 of the drive motor 144. Specifically, the drive motor may have an output shaft 212 that has a longitudinal axis (or rotation axis) that coincided with the axis of rotation 141 of the ride subassembly 120 and passes through intersection point 138. The output shaft may be rigidly affixed or attached to a first (or proximal) end of a crank arm 210 such that when the shaft 212 rotates 143 about axis 141 the crank arm 210 is also rotated.

The crank arm 210 is pivotally connected at a second (or distal) end 214 to the vehicle connection link 146. The connection at end 214 is pivotal 216 about an axis of rotation 215 such that the link 146 may rotate about the end 214 of crank arm 210 as the link 146 moves 151, 161 the vehicle subassemblies 150, 160 along their linear travel paths. As discussed with reference to FIGS. 3-5, the end 214 is moved through a circular path with rotation 143 of shaft 212 at proximal end of crank arm 210 to cause the movements 151, 161 of vehicle subassemblies 150, 160. The end 214 may be attached at or near the midpoint of the connection link 146 such that the subassemblies 150, 160 have equal travel relative to each other and relative to intersection point 138 on the travel paths in channels 135, 133.

Within each of the open channels 133, 135 of tracks 132, 134, a rolling guide assembly 282, 280 is provided. The guide assemblies 280, 282 are pivotally connected to ends 270, 272 of vehicle connection link 146 such that when the crank aim 210 is swept through its circular travel area the link 146 is also moved. In response to the movement of link 146, the guide assemblies 280, 282 are reciprocated back and forth along the length of the tracks 134, 132 within open channels 135, 133. In turn, the vehicle subassemblies 150, 160 are coupled to guide assemblies 280, 282 to move 151, 161 with the assemblies 150, 160. The coupling may be rigid such that the vehicle subassemblies 150, 160 maintain a fixed orientation relative to the guide assemblies 280, 282 or may also be a pivotal coupling such that the vehicles subassemblies 150, 160 may rotate about their linear mounting (e.g., the mounting point or location to the guide assemblies 280, 282 that causes at least the nearby portion of the subassemblies 150, 160 to travel along a linear path). The use of a pivotal coupling between vehicle subassemblies 150, 160 and guides 280, 282 may allow a single passenger vehicle (as shown) to rotate or whip or it may allow a platform/turntable/frame supporting two or more passenger vehicles to be rotated (e.g., about an axis passing through the linear mounting location).

Figure 3:
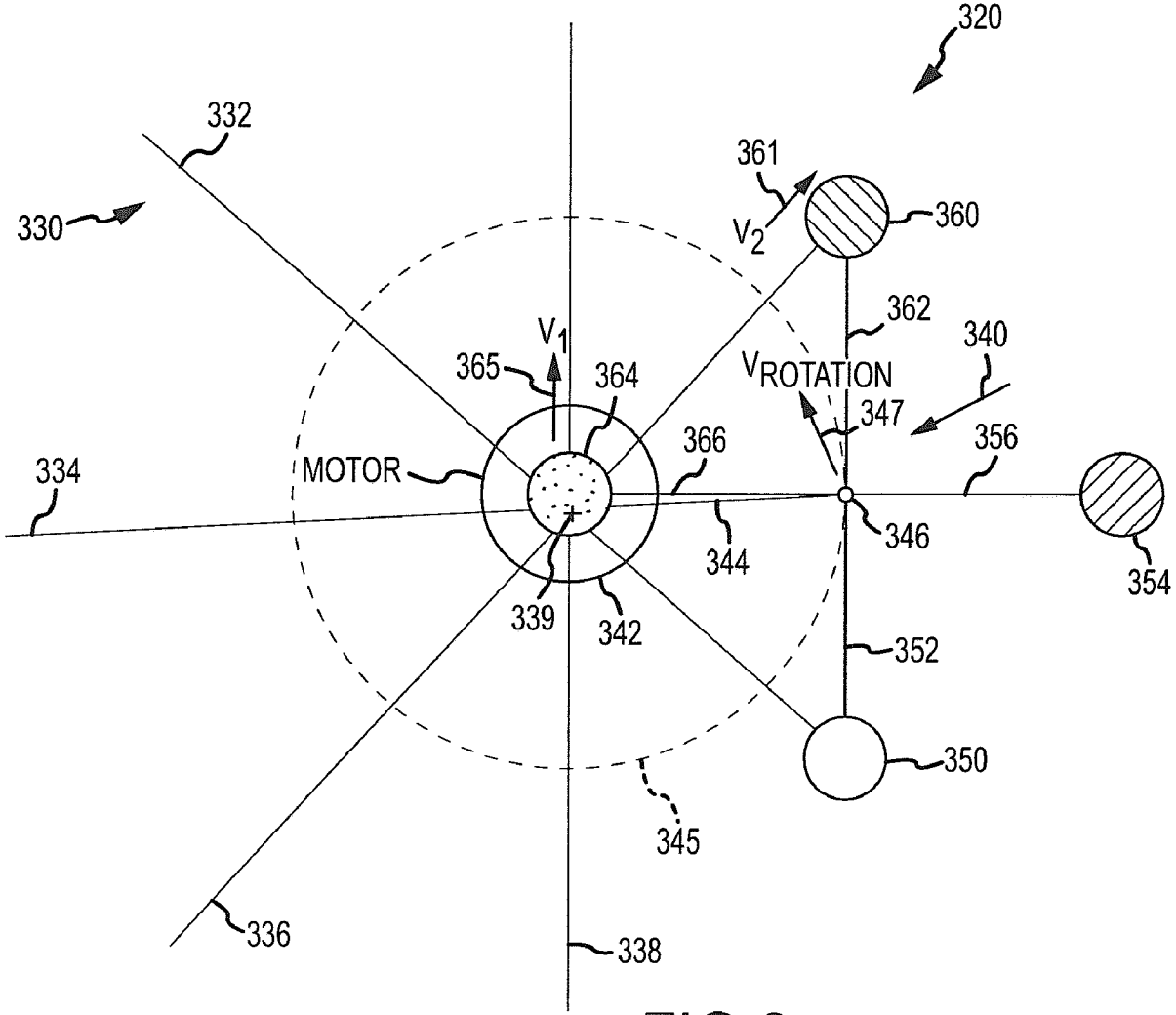
FIGS. 3-5 illustrate schematically operation of a vehicle positioning assembly to position four vehicle subassemblies along four linear pathways to provide near-miss interaction of the vehicle subassemblies (and vehicles/passengers in such vehicle subassemblies)
Figure 4:
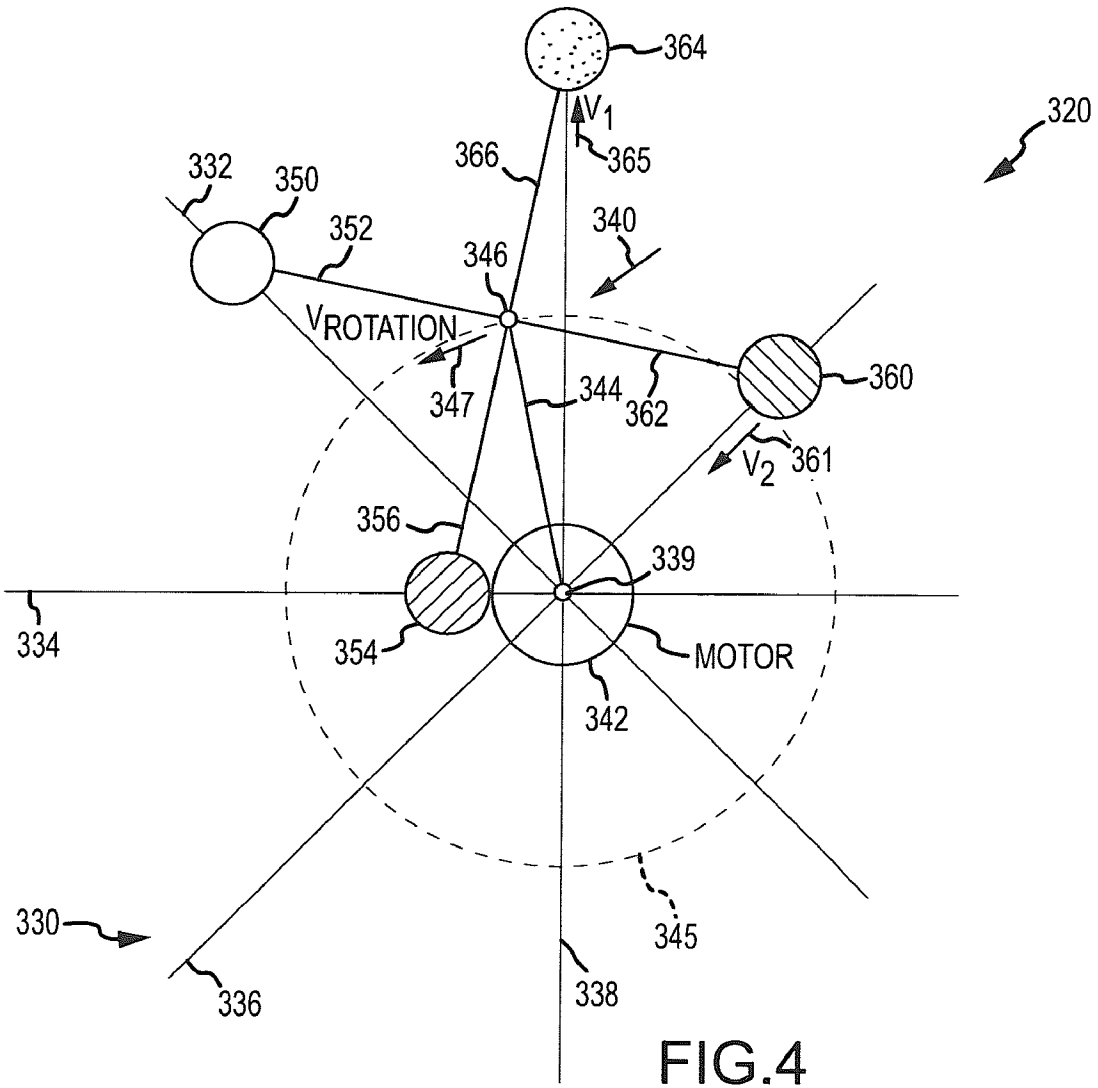
Figure 5:
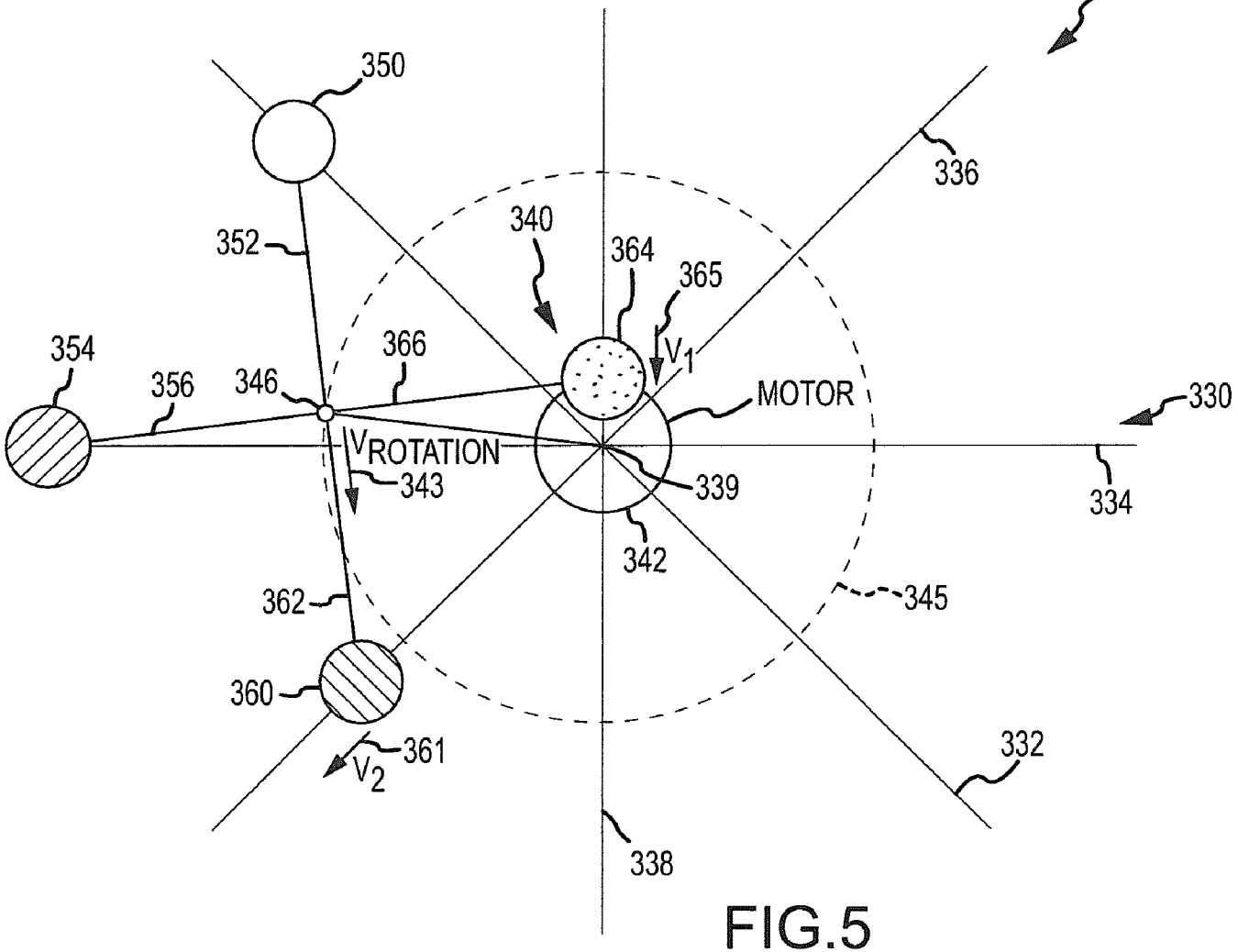

FIGS. 3-5 illustrate schematically an intersecting path ride (or ride subsystem that may be included as one of two or more such subsystems in a larger ride) 320 that provides four linear, intersecting paths. The illustrations provided in FIGS. 3-5 are useful for showing how vehicle subassemblies that are attached to a rigid connection link/frame can be moved in a reciprocating manner on dedicated linear paths by rotation of the connecting link with a crank arm (e.g., a connection point between the link and the crank arm are moved through a circular path as shown at 345).

As shown, the ride 320 includes a track assembly 330 and a vehicle positioning assembly 340. The track assembly 330 includes four track members 332, 334, 336, 338 that may be elongated or linear tracks with an interior channel (e.g., for containing a vehicle guide that, in turn is connected to the connecting link/frame) with an opening on one side/face. In this manner, each track 332, 334, 336, 338 defines a linear travel path for an associated vehicle subassembly 350, 354, 360, 364, respectively (these could also be defined at the connection points for a vehicle subassembly), and these paths are "dedicated" in the sense that only one vehicle ever travels along these paths (except for at the intersection point 339). The four tracks 332, 334, 336, 338 all intersect at an intersection point 339, which typically coincides with the midpoint of each track (or at least of the defined travel path for the vehicle subassemblies). In other words, each track member bisects the other three track members (or their paths do so) to provide an area of near misses and close interaction with the other vehicle assemblies and/or passengers of vehicles in such vehicle subassemblies.

The vehicle positioning assembly 340 includes a motor 342 linked to a crank arm 344 at a first/proximal end, and the motor 342 has an output shaft with a longitudinal axis passing through the intersection point 339 of the track-defined travel paths. The crank arm 344 is attached (pivotally) at a second/distal end 346 to a connecting link or frame that, in turn includes four arms/supports 352, 356, 362, 366 extending outward from this connect with crank arm end 346. At the end of each arm 352, 356, 362, 366 is a vehicle subassembly 350, 354, 360, 364. As discussed with reference to FIGS. 1 and 2, each of the vehicle subassemblies 350, 354, 360, 364 is typically attached or coupled to a guide that rides in an open channel of a dedicated/corresponding track member 332, 334, 336, 338, respectively, such that the vehicle subassemblies 350, 354, 360, 364 are restricted to a linear travel path of a predefined length (but that also intersects the other paths at intersection point 339).

When the motor 342 is operated to rotate its output shaft, the crank arm 344 is pivoted about its first/proximal end such that its second/distal end 346 is rotated at a velocity, $V_{Rotation}$, through a circle or circular path 345. The rotation velocity, $V_{Rotation}$, may be constant or it may be varied during operation of the ride 320. FIGS. 3-5 may be considered three snapshots or sequential points in time during the operation of the ride 320. In FIGS. 3-5, the rotation of crank arm end 346 is causing all four vehicle subassemblies 350, 354, 360, 364 to concurrently move along their dedicated linear paths defined by tracks 332, 334, 336, 338.

In FIG. 3, the vehicle subassembly 364 is traveling on its linear path as shown with arrow 365 and has just passed through the intersection point 339 of the four tracks 332, 334, 336, 338. At or near the intersection point 339, the vehicle subassembly 364 is moving at a linear velocity, $V_1$, which may be near a maximum for the vehicle subassemblies. In other words, the ride 320 may be adapted such that the vehicle subassemblies move at varying speeds with the greatest speed typically being at or near the intersection point 339 or at the closest interaction point/near-miss location of ride 320 and the slowest/lowest speed being at the outer or opposite ends of the linear travel paths (e.g., as the vehicle subassembly is changing direction to return back along the travel path in the opposite direction). The movement 347 of connection link and crank arm end 346 causes the vehicle subassembly 360 to move outward as shown with arrow 361 on its travel path defined by track 336 at a second velocity, $V_2$, which (as discussed above) typically would be less than the velocity, $V_1$, of the subassembly 364.

At the point of operation of ride 320 shown in FIG. 4, the crank arm end 346 and connecting link have been moved 347 to a second location about the circular path 345 (e.g., about 100 degrees counterclockwise). The four arms 352, 356, 362, 366 maintain the relationship/spacing between the vehicle subassemblies 350, 354, 360, 364 and also force the vehicle subassemblies 350, 354, 360, 364 to move along the tracks 332, 334, 336, 338 of track assembly 330. The arms 352, 356, 362, 366 are of equal length (as measured from the center point of the connecting link or where the link is pivotally mounted to crank arm end 346), and the length of the channel (i.e., the linear travel path) provided by each track 332, 334, 336, 338 typically is equal to four of the arms. In other words, the length of the linear path from the intersection point 339 to an end point of a channel is two times the length of an arm (a vehicle subassembly such as vehicle subassembly 364 is at the end of the channel or outer travel when a pair of arms (such as aims 356 and 366) are aligned with the open channel/linear path in its dedicated track (such as the track 338, for example).

Specifically, the movement 347 of the connecting link with its aims 352, 356, 362, 366 via the sweeping movement of crank arm 344 has caused the vehicle subassemblies 350 and 354 to move separately through the intersection point 339. The movement 347 has also caused the vehicle subassembly 364 to move out to an end of its travel path defined by track 338 (and it has begun moving back toward the intersection point 339 as shown with arrow 365), and its movement is at or near a minimum rate (as the vehicle subassembly 364 may actually briefly stop movement as it changes direction along its travel path). The vehicle subassembly 360 is moving 361 towards the intersection point 339 for close interaction with the vehicle subassemblies 354 and 365 (and a top speed, $V_2$, at such point 339).

FIG. 5 illustrates a later snapshot or point in time of operation of ride 320. In FIG. 5, end 346 of the crank arm 344 has been rotated 347 by the motor 342 about another 70 degrees about is rotation axis passing through intersection point 339. At this point, the vehicle subassembly 350 is again beginning to move toward the intersection point 339 and the subassembly 354 is near its most outward travel (e.g., near the end of path defined by track 334). The vehicle subassembly 361 has moved through the intersection point 339 with its linear movement 361 toward an end of the path defined by its dedicated track 336. The rotation of the frame/link with arms/supports 352, 356, 362, 366 via rotation of the crank arm 344 has also caused the vehicle subassembly 364 to again approach the intersection point 339 and reach its maximum speed, $V_1$.

As can be seen from FIGS. 3-5, the ongoing rotation of the crank arm 344 by motor causes each of the vehicle subassemblies to travel back-and-forth (or to reciprocate) along a linear path defined by its associated/dedicated track. For example, the vehicle subassembly 360 moves from one end to the other of the track 336 (or a linear path defined by an open channel of the track 336). The vehicle subassembly 360 passes through the intersection point 339 where it may be in close interaction or in a near miss situation with other vehicle subassemblies 350, 354, and/or 364 (differing ones in each direction). Concurrently, the movement 347 of the crank arm end and pivotally attached connection link/frame carrying the vehicle subassemblies 350, 354, 360, 364 causes the other three to reciprocate back and forth from end to end of the linear paths defined on tracks 332, 334, 338.

The above explanation explains in detail how a rotating crank arm (fixed radius to a mounting location) can be effectively used to move two or more vehicle subassemblies in a reciprocal manner along dedicated linear paths. The vehicle subassemblies are forced to move back and forth along their particular track (or linear path) by their pivotal mounting to a connection link/frame that maintains their equidistant spacing from each other, with the crank arm typically pivotally connected to a central point of the connection link/frame. The linkage is similar in some ways to a SPIROGRAPH™ geometric drawing toy available from Hasbro, Inc. However, the addition of a crank arm achieves a central rotation point (about a central rotation axis) for all vehicle subassemblies.

The intersecting path ride described avoids the need for a vehicle hand off to achieve a perception of close interaction and near-miss situations near the intersection point of the ride (intersection point of the tracks (or the paths they each define)). Constant rotation of the drive mechanism (and constant movement of the connection/coupling point between the crank arm and connection link along its circular path) results in varying speeds for the vehicle subassemblies along their linear travel paths, with the fastest speeds being proximate to the intersection point and the slowest at or near the points in the path furthest from the intersection point. The intersecting path ride provides vehicle/passenger interaction and complex (non-intuitive) motion with a very simple drive (e.g., a single drive motor with a crank aim and a rigid connection link/frame supporting the vehicle subassemblies).

In this and other embodiments, the vehicle subassembly mounting point (or linear mount location) travels in a straight line or along a linear path. A central rotation axis passes through the bisection or intersection point for these linear paths. Further, each vehicle subassembly is supported on the connection link/frame a like distance from the pivotal pointing point to the crank arm (i.e., each vehicle is equidistant from the second/distal (from the rotation axis) end of the crank arm). Typically, this distance from the vehicle subassemblies to the end of the crank arm is equal to the distance from the end of the crank arm to the rotation axis (which may be about the length of the crank arm in some cases).

With the general functioning of the ride systems of the invention understood, it may be useful to provide several additional examples of "vehicle subassemblies" that may be used in an intersecting path ride. Generally, any passenger cabin shape, size, and number may used that can fit within an acceptable, predefined vehicle envelope, which typically will have a circular shape with its center at the linear mounting point with the connection link. The radius (or size) of this vehicle envelope is selected to ensure that as the vehicle subassemblies are moved in reciprocal fashion along their dedicated tracks that the subassemblies do not come into contact and, typically, that some distance is maintained between vehicles in such subassemblies (e.g., so that passengers can reach out of a vehicle and still not come into contact with anything including a reaching passenger of another vehicle).

Figure 6A:
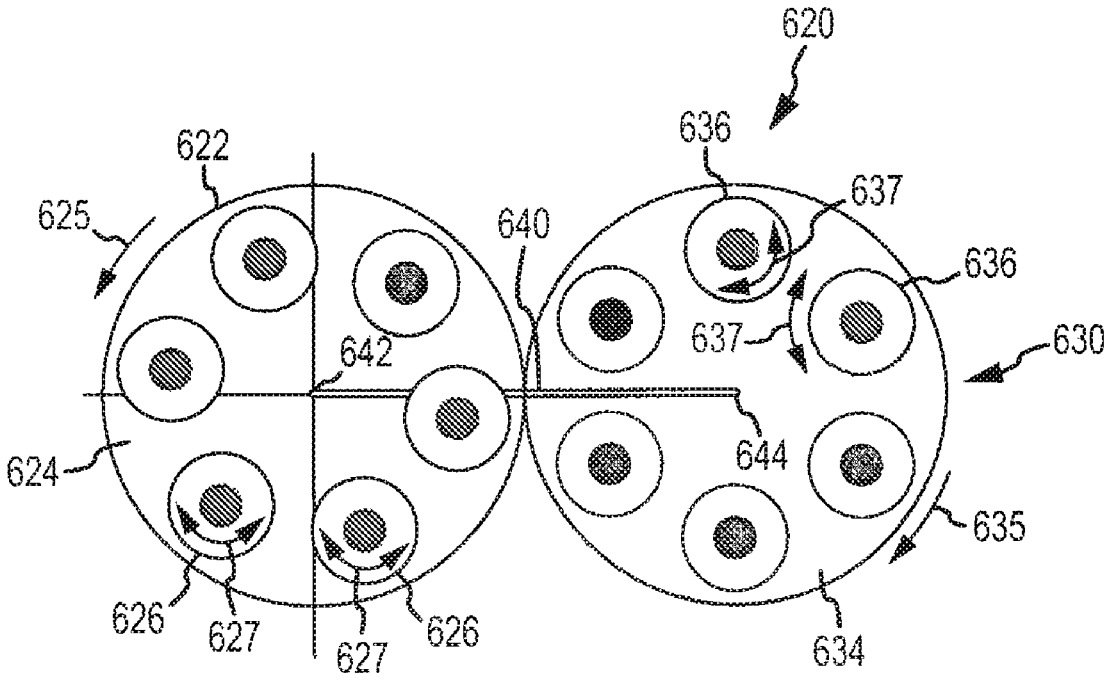
FIGS. 6A and 6B illustrate schematically that a variety of vehicle subassemblies may be provided at the ends of a connection link to practice the invention such as tea cup-type vehicles on turntables shown in FIG. 6A and whip-type vehicles constrained to move or "whip" within a circular travel area (e.g., size of the turntable or plateau of FIG. 6A) as shown in FIG. 6B (as well as other vehicle and seating configurations not shown in these figures such as disko vehicles or the like)

For example, FIG. 6A illustrates in a simplified schematic drawing a ride subsystem 620 that includes a pair of vehicle subassemblies 622, 630 that are each made up of a turntable 624, 634. The turntables 624, 634 are mounted on ends 642, 644 of a connection link 640 for rotation 625, 635 about a rotation axis extending through a center of the turntables and the connection point with the connection link 640. The link 640 is an elongated, rigid member that would be pivotally coupled to a crank arm (not shown) in a ride including subsystem 620. The turntables or platforms 624, 634 may have radii selected to be at or within the predefined vehicle envelope for the ride subsystem 620, such as less than one half of the length of the connection link 640.

The ride subsystem 620 may include one, two, or more passenger vehicles on each platform 624, 634 as shown with vehicles 626, 636. These vehicles 626, 636 may be supported on the turntables 624, 634 for rotation about their axes as shown with arrows 627, 637 (or other movement on turntable), which provides a tea-cup type ride with multiple rotations, but it also provides for unique movement of the platforms/turntables 624, 634 along linear paths.

Figure 6B:
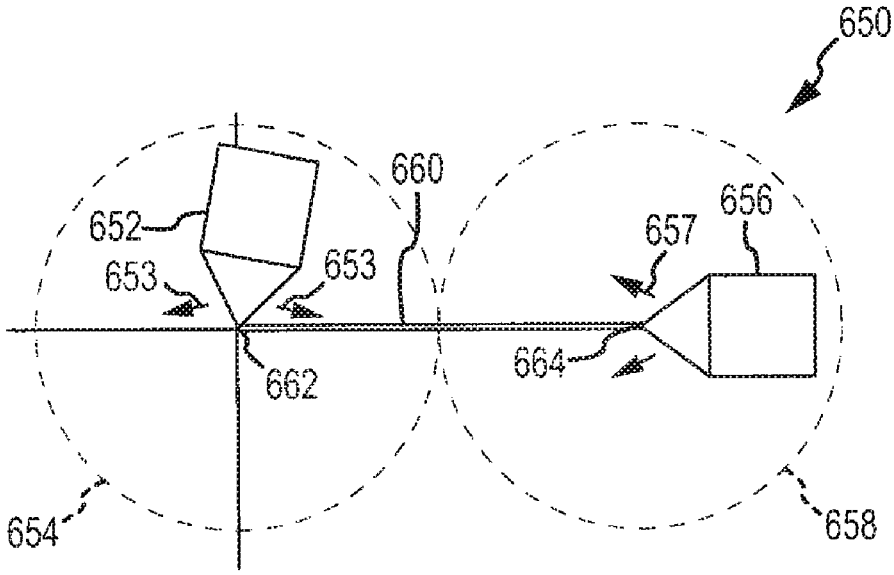

The vehicle subassembly may take the form of a single vehicle with seating for one or more passengers as shown in FIGS. 1 and 2 with assemblies 150, 160. These vehicles 150, 160 may be rigidly coupled to the connection link or may be able to rotate about such a connection/mounting location. In other cases, though, it may be desirable to have the vehicle rotate or even whip about its linear mounting point. FIG. 6B shows a ride subsystem 650 that may be used in an intersecting path ride of the invention to provide passenger vehicles 652, 656 that are able to whip from side to side as shown with arrows 653, 657 about their linear connection points 662, 664 to the ends 662, 664 of connection link 660 (again, "linear connection point" is the coupling of a vehicle subassembly with a connection link). The size (length) of the vehicles 652, 656 is selected such that the vehicles 652, 656 remain fully within vehicle envelopes 654, 658 so as to ensure no contact between the vehicles (vehicle subassemblies) 652, 656 and with a desired/required additional spacing distance. When the ride subsystem 650 is used within a ride, the vehicle subassemblies 652, 656 travel along a linear path defined by a track as the connection points 662, 664 follow an open channel, but the passengers may also act to cause the whipping movements 653, 657.

Figure 7:
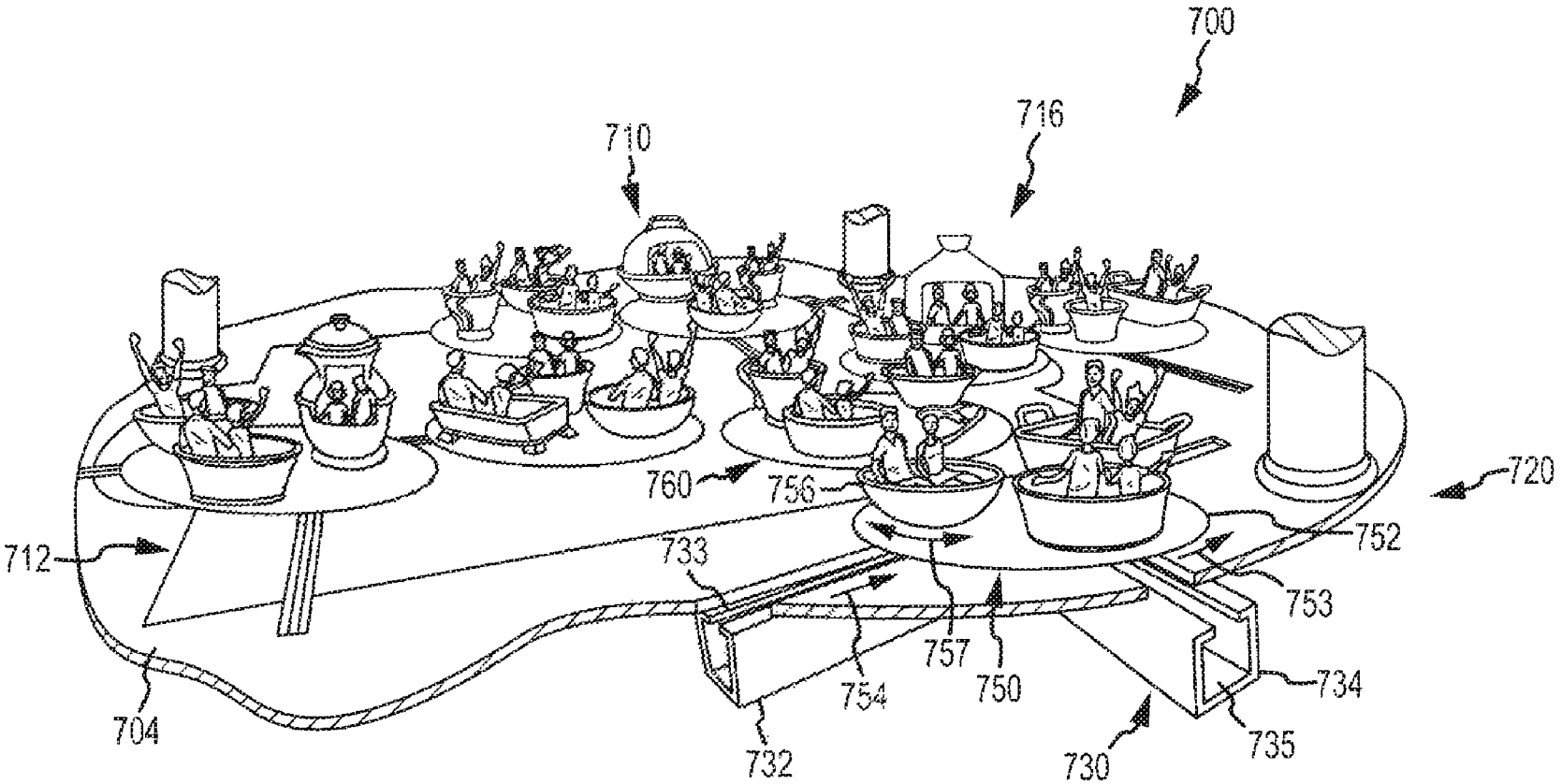
FIG. 7 illustrates a tea cup-type ride in which vehicle subassemblies, in each vehicle positioning assembly, include a rotating turntable supporting several passenger vehicles each which may be individually rotated about their mounting points and, during operation of the ride, the turntables are moved linearly in a reciprocal fashion in a path defined by the open-channel track (to nearly collide with another one of the turntables of another vehicle subassembly)

FIG. 7 illustrates an intersecting path ride 700 that may implement the concepts described herein to provide near-miss and close vehicle/passenger interaction with tea cup-type vehicles. As with the ride 100 of FIGS. 1 and 2, the ride 700 includes four ride subsystems 710, 712, 716, and 720 supported on a platform or base 704 that allows passengers to load and unload from vehicles. Ride subsystem 720 is shown in more detail in FIG. 7, and it includes a track assembly 730 made up of a pair of bisecting track members or tracks 732, 734. Each track 732, 734 is configured to define a linear channel 733, 735 within the track 732, 734 and the channels 733, 735 open up into the ride platform 704 to define linear paths or grooves for vehicle subassemblies 750, 760 to reciprocate along during operation of ride 700.

Although not shown in FIG. 7, the ride 700 would include a vehicle positioning assembly as described above for each ride subsystem 710, 712, 716, 720 that would include a drive mechanism rotating a crank arm about one of its ends to move a portion (e.g., a central point/portion) of a connection link/frame through a circular drive path. In each of the ride subsystems, this causes the two vehicle subassemblies to reciprocate back and forth along a linear path defined by the two elongated tracks with open channels.

The vehicle subassembly 750 is shown in more detail and is representative of the other vehicle subassemblies in ride 700. The vehicle subassembly 750 includes a platform or turntable 752 that supports, in this example, three passenger vehicles 756. The turntable or platform 752 is pivotally connected (at a linear mounting location) to a guide assembly (not shown) positioned within the channel 733 of dedicated track 732, and the guide assembly along with platform 752 are linearly moved back and forth along the linear path defined by channel 733 as shown with arrow 754. The vehicle subassembly 750 is shown at or near the intersecting point of the tracks 732, 734.

During this linear travel 754, the platform 752 may also be rotated about an axis passing through the guide assembly and/or the linear mounting point between the guide and the vehicle subassembly 750. Further, each of the passenger vehicles 756 may be pivotally mounted upon the platform/turntable 752 so as to be rotated 757 such as about a central axis of the vehicles 756 in response to passenger/rider input and/or ride controls. The additional movements of the turntable 753 and vehicles 756 make the reciprocal movement 754 and close interaction with other vehicle subassemblies 760 very counterintuitive to the passengers of vehicles 756.

Figure 8:
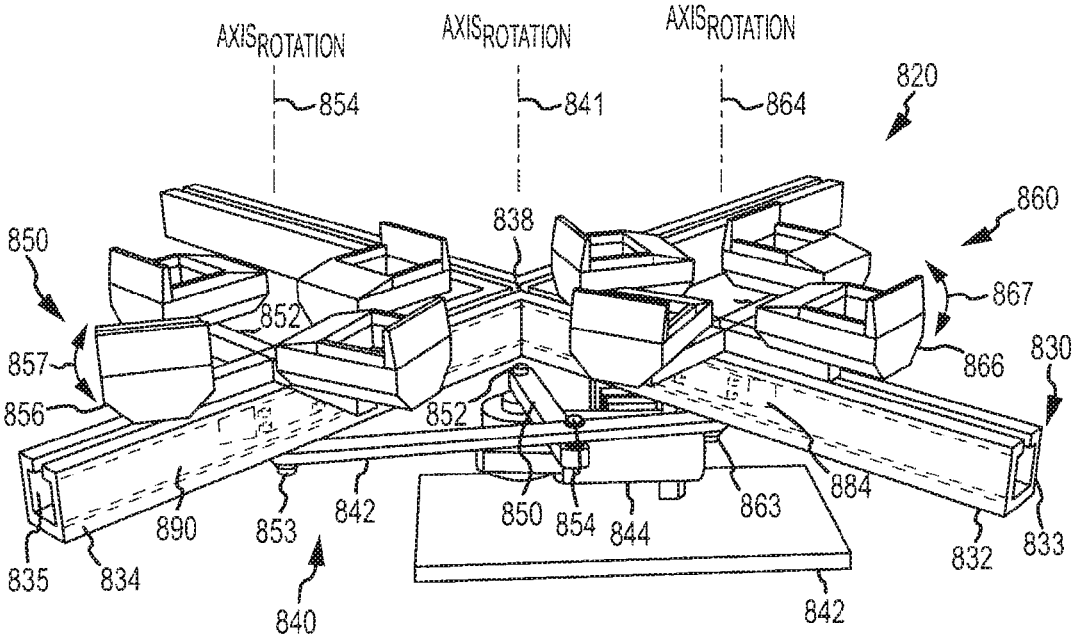
FIGS. 8 and 9 show perspective and side views, respectively, of another embodiment of a vehicle positioning assembly useful in the intersecting path rides of the present description showing vehicle subassemblies with four separately pivotal passenger vehicles on a rigid frame structure (which may also be rotated about a mounting point/connection to a rolling guide assembly moving linearly within a linear track channel).
Figure 9:
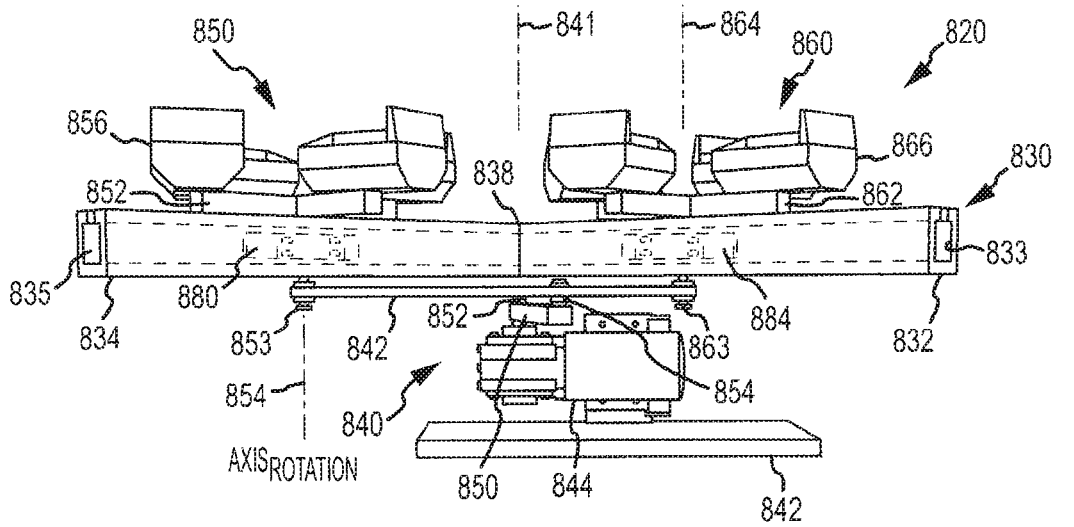

FIGS. 8 and 9 illustrate an additional embodiment of a ride subsystem 820 that may be used in an intersecting path ride (such as in ride 100 of FIG. 1). The ride subsystem 820 includes a track assembly 830 along with a vehicle positioning assembly 840 useful for reciprocating a pair of vehicle subassemblies 850, 860 along linear paths provided by track assembly 830. The track assembly 830 includes a first track 832 with a linear, open channel 833 defining a dedicated path for vehicle subassembly 860 and further includes a second track 834 with a linear, open channel 835 defining a dedicated path for vehicle subassembly 850. The channels 833, 835 intersect at point 838 where the tracks 832, 834 bisect each other in the track assembly 830, which allows the vehicle subassemblies 850, 860 to pass through a common position with other components of the vehicle positioning assembly 840 ensuring that near-misses are provided in a safe manner.

Particularly, the vehicle positioning assembly 840 includes a drive motor 844 supported upon a base 842, and, during operation of the ride subsystem 820, the drive motor 844 rotates an output or crank shaft 852 (e.g., at a constant or variable revolutions per minute to obtain desired vehicle velocities along the channels 833, 835). The longitudinal axis of the shaft 852 of the motor 844 coincides with the intersection point 838 as well as with an axis of rotation 841 for the ride subsystem 820. A crank arm 850 is rigidly coupled at a first or proximate end to the output shaft 852 to rotate with the shaft 852 about the axis of rotation 841, which causes a second or distal end 854 of the crank arm 850 to move or be swept through a circular path (with a radius equal to the distance from the axis 841 to the end 854 (or a center axis of a coupling between the crank arm 850 and connection link 842).

The second or distal end 854 of the crank arm 850 is pivotally connected or coupled with a connection link/frame 842, such as at a central point between two ends 853, 863 of the link 842. The length of the connection link 842 (or, more accurately, the distance between the connection locations/ends 853, 863) defines a separation distance between the linear mounting points of the vehicle subassemblies 850, 860, and, in general, one half of this length is equal to a radius of the vehicle envelop used to determine a safe (non-contact) design for each vehicle subassembly 850, 860. The vehicle positioning assembly 840 includes vehicle guides 880, 884 that travel within the channels 835, 833, respectively, in response to movement of the crank arm 850 and connection link 842 during operation of motor 844. The guide 880 is pivotally connected at end 853 to link 842 while guide 884 is pivotally connected at end 863 to link 842.

In this embodiment of a ride subsystem 820, the vehicle subassemblies 850, 860 include a vehicle frame/platform 852, 862 that is pivotally connected at the linear mounting location to guide assemblies 880, 884. The axes of rotation 854, 864 for the vehicle frames 852, 862 extend through ends 853, 863 of the connection link, and, in this manner, the axes of rotation 854, 864 coincide with the linear mounting location of the vehicle subassemblies 850, 860. During operation, the ride subsystem 820 may operate to rotate the vehicle frames/platforms 852, 862 about the axes 854, 864 concurrently or separate from rotation of the crank arm 850 about the center axis of rotation 842 (which causes reciprocating, linear motion of the vehicle subassemblies 850, 860 along linear paths defined by channels 835, 833).

The vehicle subassemblies 850, 860 also include a number of passenger vehicles 856, 866. These may be rigidly affixed to frames 852, 862 or, as shown, may be coupled with the frames 852, 862 for swiveling or pivoting 857, 867. This vehicle movement 857, 867 may be in response to gravity or other forces applied to the vehicles 856, 866 during operation of ride subsystem 820 and/or may be in response to control system input to operate one or more drives or to user input/operation of vehicle controls (such as manually turning a wheel in the vehicle, shifting their weight, or the like). The vehicle movements 857, 867 may be concurrent with the rotations about axes 841, 854, 864 or separate from (independent of) such movements.

Although the invention has been described and illustrated with a certain degree of particularity, it is understood that the present disclosure has been made only by way of example, and that numerous changes in the combination and arrangement of parts can be resorted to by those skilled in the art without departing from the spirit and scope of the invention, as hereinafter claimed. For example, the vehicle subassembly may include take the form of a large circular vehicle subassembly with a perimeter array of seats arranged to be contained within a vehicle envelope.

We claim:

1. An intersecting path ride, comprising:

a track assembly defining a first linear channel and a second linear channel, wherein the channels are open on one side and wherein the channels intersect at an intersection point;

first and second guides adapted for moving within the first and second channels, respectively;

first and second vehicle subassemblies connected to the first and second guides, respectively, wherein the vehicle subassemblies each include at least one passenger vehicle and wherein the vehicle subassemblies move with the guides relative to the track assembly; and a vehicle positioning assembly concurrently reciprocating the first and second guides back and forth along the first and second linear channels, respectively, whereby the first and second vehicle subassemblies separately pass the intersection point, wherein the vehicle positioning assembly includes a rigid connection link pivotally coupled to the first and second guides and wherein the vehicle positioning assembly reciprocates the first and second guides with selective movement of the connection link.

2. The ride of claim 1, wherein the vehicle positioning assembly further comprises a drive mechanism operable to selectively rotate a crank arm, the crank arm being rigidly attached at a first end to the drive mechanism and pivotally mounted at a second end to the connection link.

3. The ride of claim 2, wherein the drive mechanism comprises a rotating output shaft rigidly coupled to the first end of the crank arm and with a longitudinal axis extending through the intersection point of the channels.

4. The ride of claim 2, wherein the first and second channels bisect each other at the intersection point.

5. The ride of claim 4, wherein the connection link is configured such that connection points between the connection link and the first and second guides are equidistant from the second end of the crank arm.

6. The ride of claim 5, wherein a length of the crank arm is about a distance between one of the connection points and second end of the crank arm.

7. An intersecting path ride, comprising:

a track assembly defining a first linear channel and a second linear channel, wherein the channels are open on one side and wherein the channels intersect at an intersection point;

first and second guides adapted for moving within the first and second channels, respectively;

first and second vehicle subassemblies connected to the first and second guides, respectively, wherein the vehicle subassemblies each include at least one passenger vehicle and wherein the vehicle subassemblies move with the guides relative to the track assembly; and a vehicle positioning assembly concurrently reciprocating the first and second guides back and forth along the first and second linear channels, respectively, whereby the first and second vehicle subassemblies separately pass the intersection point, wherein the first and second vehicle subassemblies each further comprise a turntable supporting at least one passenger vehicle, wherein the turntable rotates about an axis extending through a corresponding one of the guides, and wherein at least one passenger vehicle is pivotally coupled with the turntable for movement independent of movement of the turntable.

8. An intersecting path ride, comprising:

a track assembly defining a first linear channel and a second linear channel, wherein the channels are open on one side and wherein the channels intersect at an intersection point;

first and second guides adapted for moving within the first and second channels, respectively;

first and second vehicle subassemblies connected to the first and second guides, respectively, wherein the vehicle subassemblies each include at least one passenger vehicle and wherein the vehicle subassemblies move with the guides relative to the track assembly; and a vehicle positioning assembly concurrently reciprocating the first and second guides back and forth along the first and second linear channels, respectively, whereby the first and second vehicle subassemblies separately pass the intersection point, wherein the at least one passenger vehicle is pivotally coupled to a corresponding one of the guides proximate to one end of a body, whereby an opposite end of the body is rotatable away from the channel during linear movement of the at least one passenger vehicle relative to the channel.

9. An amusement park ride providing intersecting vehicle paths, comprising:

a drive motor selectively rotating an output shaft;

a crank arm rigidly coupled at a first end to the output shaft;

a connection link pivotally coupled to a second end of the crank arm at about a midpoint of the connection link;

a first vehicle subassembly pivotally coupled to a first end of the connection link;

a second vehicle subassembly pivotally coupled to a second end of the connection link, whereby the first and second vehicle subassemblies are equidistant from the second end of the crank arm; and a track assembly defining first and second linear paths that bisect each other, wherein the track assembly restrains the first vehicle to move along the first linear path and the second vehicle to move along the second linear path when the drive motor is operated to rotate the output shaft.

10. The ride of claim 9, wherein the track assembly comprises two elongated tracks each having a body providing an open channel defining one of the linear paths and wherein the ride further comprises a guide assembly riding within each of the channels that is coupled to one of the vehicle subassemblies and one of the ends of the connection link.

11. The ride of claim 9, wherein the crank arm has a length measured from the first end to the second end that is about half a length of the connection link as measured from the first to the second end of the connection link.

12. The ride of claim 9, wherein the first and second vehicle subassemblies include a platform rotating about a central axis, the central axis passing through a mounting location to an end of the connection link, and further wherein the first and second vehicle subassemblies each include at least two passenger vehicles pivotally attached to the platform.

13. The ride of claim 12, wherein the connection link has a length as measured between the first and second ends that is greater than a predefined value, whereby when one of the vehicle subassemblies is proximate to a bisection point of the first and second linear paths the other one of the vehicle subassemblies is spaced apart and positioned at a distal point on the associated linear path relative to the bisection point.

14. An intersecting path ride, comprising:

a track assembly comprising four tracks each with a body providing a linear open channel, wherein the channels bisect each other at an intersection point and have equal angular separation from adjacent ones of the channels;

a vehicle positioning assembly including a drive mechanism rotating a crank arm about a rotation axis passing through a first end of the crank arm and through the intersection point, wherein the positioning assembly further includes a connection frame connected at a midpoint to a second end of the crank arm, the connection frame including four arms extending outward from the midpoint; and first, second, third, and fourth vehicle subassemblies associated with one of the four tracks, wherein the first, second, third, and fourth vehicle subassemblies are each coupled to an end of one the four arms, whereby the first, second, third, and fourth vehicle subassemblies concurrently travel along linear paths defined by the channels as the midpoint of the connection frame is driven through a circular drive path by the crank arm.

15. The ride of claim 14, wherein the four arms of the connection frame have substantially equal lengths.

16. The ride of claim 14, wherein the drive mechanism comprises a drive motor driving the crank arm with an output shaft at a substantially constant rate and wherein each of the vehicle subassemblies has a maximum linear velocity proximate to the intersection point and a minimum linear velocity distal to the intersection point on one of the linear paths.

17. The ride of claim 16, wherein the drive motor rotates the output shaft at a rate selected from a range of rates, whereby the maximum and minimum linear velocities are varied during operation of the ride.

18. The ride of claim 14, wherein each of the vehicle subassemblies comprises a turntable supporting two or more passenger vehicles, the turntable being coupled to the end of one of the arms and the turntable rotating about an axis passing through the turntable, one of the channels, and one of the ends of the four arms.

19. The ride of claim 14, wherein each of the vehicle subassemblies includes a passenger vehicle pivotally supported to rotate as the vehicle subassembly is reciprocated along one of the linear paths, the passenger vehicles being spaced apart within predefined vehicle envelopes when one of the vehicle subassemblies is positioned proximate to the intersection point.

* * * * *